US005573640A

United States Patent [19]

Frederick et al.

[11] Patent Number: 5,573,640

[45] Date of Patent: Nov. 12, 1996

[54] PAPER MADE WITH CELLULOSE FIBERS HAVING AN INNER CORE OF CELLULOSE ACETATE

[75] Inventors: Tim J. Frederick; Melvin G. Mitchell; Lee R. Partin, all of Kingsport, Tenn.

[73] Assignee: Eastman Chemical Company, Kingsport, Tenn.

[21] Appl. No.: 506,986

[22] Filed: Jul. 28, 1995

[51] Int. Cl.[6] ..... D21H 13/02

[52] U.S. Cl. ..... 162/146; 162/5; 162/8; 162/9; 162/147; 162/157.6; 162/182; 162/189

[58] Field of Search ..... 162/9, 100, 146, 162/182, 147, 189, 157.6, 5, 6, 8, 90; 428/373; 8/125, 129

[56] References Cited

U.S. PATENT DOCUMENTS

| | | | |
|---|---|---|---|
| 1,631,750 | 6/1927 | McIntosh . | |
| 2,116,063 | 5/1938 | Dreyfus | 8/129 |
| 2,208,653 | 7/1940 | Whitehead | 162/146 |
| 2,477,000 | 7/1949 | Osborne | 162/146 |
| 2,887,429 | 5/1959 | Griggs | 162/157.6 |
| 3,093,534 | 6/1963 | Filling | 162/146 |
| 4,040,856 | 8/1977 | Litzinger | 106/170 |
| 4,047,862 | 9/1977 | Keith | 425/8 |
| 4,460,647 | 7/1984 | Keith | 428/369 |
| 4,512,849 | 4/1985 | Brandon et al. | 162/146 |
| 5,213,883 | 5/1993 | Mehta | 428/224 |

FOREIGN PATENT DOCUMENTS

| | | |
|---|---|---|
| 49-6761 | 2/1974 | Japan . |
| 52-96231 | 8/1977 | Japan . |
| 52-96208 | 8/1977 | Japan . |

OTHER PUBLICATIONS

Derwent Abst. 80–2799c (abstract of JP 54151698).
Paperchem Abst 73:3579 (Dudonis).

*Primary Examiner*—Peter Chin
*Attorney, Agent, or Firm*—Cheryl J. Tubach; Harry J. Gwinnell

[57] ABSTRACT

A composition of paper comprising 99 to 10 weight percent cellulose fibers and 1 to 90 weight percent cored cellulose fibers that are uniformly dispersed within the paper. The cored cellulose fibers are composed of a cellulose sheath that is 4 to 15 weight percent of the weight of the fiber and a cellulose acetate core. The cored cellulose fibers contain no substantial crimp and have an average length of 1 to 7 mm, a density of 1.20 to about 1.35 gm/cc, a denier 1 to 30 grams per 9,000 meters and a uniform dispersion index of less than 0.15.

9 Claims, No Drawings

PAPER MADE WITH CELLULOSE FIBERS HAVING AN INNER CORE OF CELLULOSE ACETATE

TECHNICAL FIELD

The present invention relates generally to compositions of paper and more particularly to the combination of different types of cellulose fibers therein.

BACKGROUND OF THE INVENTION

The addition of cellulose acetate fibers to paper is well known in the art. U.S. Pat. No. 4,040,856 to Litzinger contains an extrusion process for making cellulose acetate fibers for papermaking. The fibers are suitable for direct addition to conventional papermaking methods. Two related patents, U.S. Pat. Nos. 4,047,862 and 4,460,647 by Keith, disclose a cellulose acetate fiber for use in paper applications which is produced by precipitation of cellulose acetate from a dope under high shear conditions. In U.S. Pat. No. 5,213,883 by Mehta, a decorative sheet is disclosed having 1 to 20 weight percent cellulose acetate fibers added to cellulose pulp and $TiO_2$. Japanese Patent Nos. 52,096,208 and 52,096,231 to Shiyuuichi et al. are for another form of cellulose acetate fibers which are mixed with staple fibers for making into paper.

However, the amount of cellulose acetate fibers that can be added to paper without substantial linting during the printing process is typically below 10 weight percent, thus limiting the extent of thermoplastic properties to the paper. With binders the cellulose acetate fiber content may be doubled, however this technology is not desirous because of the expense and difficulty in processing binders.

Thus, there exists a need in the art to obtain a paper product with enhanced thermoplastic properties by the addition of greater quantities of cellulose acetate fibers which does not have the problems associated with linting and using binders.

SUMMARY OF THE INVENTION

A composition of paper comprising 99 to 10 weight percent cellulose fibers and 1 to 90 weight percent cored cellulose fibers that are uniformly dispersed within the paper. The cored cellulose fibers (hereinafter also referred to as "CC fibers") are composed of a cellulose sheath that is about 4 to about 15 weight percent of the weight of the fiber and a cellulose acetate core. The CC fibers contain no substantial crimp. The average length of the CC fibers is in the range of 1 to 7 mm. The density of the CC fibers is in the range of 1.20 to about 1.35 gm/cc. The CC fibers have a denier in the range of 1 to 30 grams per 9,000 meters and a uniform dispersion index of less than 0.15.

In a more preferred embodiment the cored cellulose fibers are composed of a cellulose sheath that is about 5 to about 10 weight percent of the weight of the fiber and a cellulose acetate core.

DETAILED DESCRIPTION OF THE INVENTION

A new paper composition is created by adding cored cellulose fibers to standard hardwood and/or softwood pulps when preparing a paper furnish. The CC fibers are uniformly dispersed in the paper and are characterized by specific limitations pertaining to their average length, their density, their denier, and the uniformity of their dispersion.

The CC fibers have a sheath of cellulose and a core of cellulose acetate. The sheath is a fibrillated surface of regenerated cellulose that is produced by the reaction of cellulose acetate fibers with a base such as sodium hydroxide. The reaction replaces the acetyl groups on the surface of the cellulose acetate fiber with hydroxyl groups thereby creating a fiber with a cellulose surface and cellulose acetate core. The sheath constitutes about 4 to about 15 weight percent of the fiber weight, which may also be expressed as 6.3 to 22.2% acetyl group removal and 2.4 to 8.5 weight percent fiber loss. A minimum of 4 weight percent regenerated cellulose is required to get the desired cellulose behavior of the CC fiber. In a more preferred embodiment, the sheath weight percent ranges from about 5 to about 10. The upper limit of 10 weight percent maximizes the thermoplastic properties of the paper.

Copending application Ser. No. 08/375,140, filed Jan. 19, 1995, herein incorporated by reference, discloses the CC fiber and a preferred process for its production. The process contains the following ten steps: (1) processing filter tow into a tow band, (2) applying a strong base, such as sodium hydroxide, to create the desired fibrillated surface, (3) removing crimp, (4) holding for reaction time, (5) washing, (6) dewatering, (7) adding lubricant, (8) drying the tow, (9) staple cutting and (10) packaging.

In copending application Ser. No. 08/375,766, filed Jan. 19, 1995, incorporated herein by reference, a paper containing uniformly dispersed cellulose acetate fibers of specific dimensions and with substantially no fibrillation is disclosed. These fibers may be added in amounts up to 90 weight percent with improved processing and performance properties over conventional cellulose acetate fibers. However, problems still occur with linting during the printing process. In accordance with the present invention, it was discovered that by utilizing the specific dimensional characteristics of the cellulose acetate fibers in Ser. No. 08/375,766 as a model for the CC fibers, a substantially lint free paper comprising large compositions of CC fibers could be produced even though such fibers are fibrillated.

Based on the weight of the cellulose and CC fibers, the amount of CC fibers in the paper can broadly comprise 1 to 90 weight percent and the amount of cellulose fibers can broadly comprise 99 to 10 weight percent. In a preferred embodiment, the amount of cellulose fibers is 95 to 10 weight percent and the amount of CC fibers is 5 to 90 weight percent and in the most preferred embodiment the amount of cellulose fibers is 90 to 15 weight percent and the amount of CC fibers is 10 to 85 weight percent.

An important feature of the CC fibers in the paper is their weighted average length. Broadly, these CC fibers have a weighted average length in the range of 1 to 7 mm, as measured in accordance with TAPPI (Technical Association of the Pulp and Paper Institute) Standard T 232 cm- 85. In a preferred embodiment, the CC fibers have a weighted average length in the range of 1 to 4 min.

The length of the CC fibers used to prepare the paper of this invention is longer than the length of the CC fibers in the paper. The reduction in length results from mechanical manipulation of the CC fibers in the confricating or refining step of the process used to prepare the paper. For example, when the CC fibers are prepared in accordance with the preferred embodiment disclosed in Ser. No. 08/375,140, the length of the fibers used to prepare the paper of this invention is in the range of ⅛ inch to ¾ inch and is preferably about ¼ inch.

The CC fiber used to prepare the paper of this invention must exhibit specific characteristics with regard to linearity.

The CC fiber must exhibit no substantial crimp. By the term "no substantial crimp", it is meant that the fiber exhibits no substantial absence of linearity induced by mechanical means, such as mechanical or pneumatic crimpers. Examples of fibers which are within the meaning of no substantial crimp are decrimped filter tow staple and staple cut acetate yarn. Examples of fibers which are beyond the meaning of no substantial crimp are crimped polyester yarn and filter tow.

Density is another significant feature of the CC fibers in the paper of this invention. Broadly, the CC fibers have a density in the range of 1.20 to 1.35 gm/cc, as measured as true solid densities using a Quanta Chrome Penta-Pycnometer. In a preferred embodiment, the CC fibers have a density in the range of 1.22 to 1.31 gm/cc. Since there is no density change in the CC fibers during the process for preparing the paper, the density of the CC fibers in the paper is the same as the density of the CC fibers used to prepare the paper.

In comparison of densities for CC fibers, cellulose acetate fibers and cellulose fibers, the CC fibers were found to have the lowest density. The respective densities of the fibers measured on a Quanta Chrome Penta-Pychnometer were about 1.26, 1.31, and 1.53 gm/cm.

The size of the individual CC fibers in the paper of this invention is also significant. The size of the individual CC fibers is in the range of 1 to 30 grams per 9,000 meters, and more preferably in the range of 1 to 10. This expression of size is also known as denier. Since there is no size change in the CC fibers during the process for preparing the paper, the size of the CC fibers in the paper is the same as the size of the CC fibers used to prepare the paper.

In this invention the CC fibers have a particular uniform dispersion. The uniform dispersion is ascertained by first determining the number of CC fibers per milligram in each of a statistically valid number of samples. Next, the standard deviation and average of the number of CC fibers per milligram are calculated. Then the standard deviation is divided by the average and this decimal number is defined as the "uniform dispersion index." In this invention, the uniform dispersion index is less than 0.15, preferably less than 0.10.

The paper of the present invention is produced by a specific process. Broadly, this process is comprised of the steps of.

(A) slurring cellulose and CC fibers, (B) confricating the slurry using a specific amount of energy, (C) diluting the confricated slurry, (D) preparing a paper from the diluted confricated slurry, (E) dewatering the paper, and (F) drying the paper.

The cellulose fiber used to prepare the paper of this invention is conventional paper making cellulose fiber obtained from wood, cotton, hemp, bagasse, straw, flax and other plant sources. Both hardwood and softwood may be used.

The first step of the process involves slurring the cellulose and CC fibers. The term "slurring" means the agitation of a solid in water to wet and disperse the solid. The slurry is composed of about 5 to 15 weight percent, preferably 5 to 10 weight percent, of an admixture of 99 to 10 weight percent cellulose fibers and 1 to 90 weight percent CC fibers, based on the weight of the admixture, and is prepared in accordance with conventional paper making techniques using conventional paper making equipment. In a more preferred embodiment, the admixture contains from 95 to 10 weight percent cellulose fibers and from 5 to 90 percent CC fibers and in the most preferred embodiment the admixture contains from 90 to 15 weight percent cellulose fibers and from 10 to 85 weight percent CC fibers. Other materials typically employed in paper making can also be present in the slurry.

The slurry is then subjected to a confrication step. The term "confrication" means a mechanical action which results in shortening and fraying the cellulose and CC fibers as a result of energy being imparted into the slurry. The shortening and fraying during the confrication step results in an increase in the amount of intimate contact of the cellulose and CC fiber surfaces during preparation of the paper. The confrication step can be performed using devices well known in the art, such as a disc refiner, a double disc refiner, a Jordan refiner, a Claflin refiner and a Valley-type refiner.

The amount of energy imparted to the slurry during the confrication step is measured as the horsepower input during the confricating step divided by the paper production rate in dry tons per day and is expressed as HP-day per ton of paper. The amount of energy is broadly in the range of 5 to 30 HP-day per ton of paper, preferable in the range of 9 to 20 HP-day per ton of paper.

The confricated slurry is then diluted with water using conventional paper making equipment such that the cellulose and CC fibers are present in an amount of less than 1 weight percent, and preferably between 0.4 to 0.8 weight percent, based on the total weight of the slurry.

The diluted confricated slurry is then prepared into a paper using conventional paper making equipment.

In the next step of the process the paper is dewatered using conventional paper making equipment. The term "dewatering" means removing the water from the paper by means of drainage or pressing operations applied to the paper by conventional papermaking methods. The dewatering useful in this invention can include drainage on a Fourdrinier, cylinder machine, multi-wire former, roto-former and pressing by various felted wet press designs. During the dewatering step the paper is formed into a sheet of consolidated fibers which, upon drying, can be processed into dry roll or sheet form.

The paper is then dried using conventional paper making equipment to a moisture content of less than 10 weight percent water, based on the total weight of the paper.

The paper of this invention can contain a wide variety of conventional materials normally added to paper. For example, the paper can contain fillers, such as calcium carbonate, clay, titanium dioxide, aluminum oxide and aluminum trihydrate, sizes, other synthetic fibers, starch and various chemical modifiers, such as wet strength enhancers, dry strength enhancers and coatings.

The paper of this invention and its preparation are illustrated by the following examples.

EXAMPLE 1

Papers containing CC fibers were produced on a pilot-scale Fourdrinier paper machine. Batches with a furnish ratio of 50% Pensicola hardwood, 42% Prince Albert softwood and 8% CC fibers were prepared and papered out. The CC fibers were prepared in accordance with Ser. No. 375, 140. The papers were produced at 60 lb/3000 sqft basis weight and run in the normal manner for the machine with 160 kw-hrs/metric ton of refining load. The chemical furnish was precipitated calcium carbonate, Sta-Lok 400 starch, Hercon 70 internal sizing and Reten 1523H retention aid.

Test papers were printed to determine their acceptability for offset printing applications. A control sheet made with 8 wt % of cellulose acetate fibers showed heavy linting on all blankets of the offset printing press. Linting was also present to an unacceptable level on samples made with CC fibers having a cellulose sheath of 0.3 wt % and 3 wt % of the fiber. A paper made with 8 wt % CC fibers and each fiber having a cellulose sheath of 6 wt % of the fiber had minimal linting and showed an acceptable lint rating for commercial applications. This work set the lower limit of 4 wt % cellulose sheath for the CC fiber.

EXAMPLE 2

Papers containing CC fibers were produced having the same furnish ratio and in accordance with the procedures of Example 1. The papers contained CC fibers with 0.3, 3.3, and 6.7 wt % cellulose sheath of the fiber. Control papers were made with no CC fiber. One sample was 100 wt % cellulose fibers and the other sample had 8 wt % cellulose acetate fibers substituted for the 8 wt % CC fibers. Test papers of each kind were printed to determine their acceptability for offset printing applications. The control paper with cellulose fibers only and the paper with 8 wt % CC fibers having 6.6 wt % cellulose sheath showed acceptable printing and linting performance. The other samples had significant problems with printing and linting.

EXAMPLE 3

Several paper samples were produced on a 36" Fourdrinier machine to show a wide range of product compositions available using the CC fibers. The batch size was approximately 600 lbs. Batches were produced at 17%, 33%, 50% and 67% by weight CC fibers with the remaining fibers being 80% Federal Paper Board Co. Albacel softwood and 20% Federal Paper Board Co. Astracel hardwood. The chemical furnish was Sta-Lok 400 starch and Hercon 70 internal sizing. 100 lb per 3,000 sqft basis weight sheets were produced.

The paper of this invention has special properties that are derived from the addition of the CC fibers. The paper contains all cellulose fibers, yet has a high thermoplastic content due to the nature of the CC fibers. The cellulose sheath of the CC fibers make the fibers act in a similar fashion as standard paper pulp in the paper. The CC fibers and cellulose fibers naturally bond together thereby eliminating the need for binders and substantially eliminating linting even at high concentrations of the CC fibers. The core of cellulose acetate adds the desired thermoplastic properties to the paper. The specific dimensional characteristics of the CC fibers result in the paper having an increased porosity, decreased density and improved dimensional stability.

We claim:

1. A paper comprising from about 99 to about 10 weight percent cellulose fibers and from about 1 to about 90 weight percent cored cellulose fibers uniformly dispersed in said paper, and wherein said cored cellulose fibers comprise a cellulose sheath being from about 4 to about 15 weight percent of the weight of said cored cellulose fiber and a cellulose acetate core;

contain no substantial crimp; and have an average length from about 1 to about 7 mm, a density from about 1.20 to about 1.35 gm/cc, a denier from about 1 to about 30 grams per 9,000 meters, and a uniform dispersion index of less than 0.15.

2. The paper of claim 1 wherein said cellulose sheath is from about 5 to about 10 weight percent of said cored cellulose fiber.

3. The paper of claim 1 wherein the amount of said cellulose fibers is from about 95 to about 10 weight percent and the amount of said cored cellulose fibers is from about 5 to about 90 weight percent.

4. The paper of claim 3 wherein the amount of said cellulose fibers is from about 90 to about 15 weight percent and the amount of said cored cellulose fibers is from about 10 to about 85 weight percent.

5. The paper of claim 1 wherein the average length of said cored cellulose fibers is from about 1 to about 4 min.

6. The paper of claim 1 wherein the density of said cored cellulose fibers is from about 1.22 to about 1.31 gm/cc.

7. The paper of claim 1 wherein the denier of said cored cellulose fibers is from about 1 to about 10 grams per 9,000 meters.

8. The paper of claim 1 wherein the uniform dispersion index of said cored cellulose fibers is less than 0.10.

9. A paper comprising from about 90 to about 15 weight percent cellulose fibers and from about 10 to about 85 weight percent cored cellulose fibers uniformly dispersed in said paper, and wherein said cored cellulose fibers are composed of a cellulose sheath that is from about 5 to about 10 weight percent of said cored cellulose fiber and a cellulose acetate core, have an average length in the range of 1 mm to 4 mm, contain no substantial crimp, have a density in the range of 1.22 to 1.31 gm/cc, have a denier in the range of 1 to 10 grams per 9,000 meters and have a uniform dispersion index of less than 0.10.

* * * * *

UNITED STATES PATENT AND TRADEMARK OFFICE

CERTIFICATE OF CORRECTION

PATENT NO. : 5,573,640

DATED : November 12, 1996

INVENTOR(S) : Tim J. Frederick, et al.

It is certified that error appears in the above-indentified patent and that said Letters Patent is hereby corrected as shown below:

Column 6, line 29 (Claim 5, line 2), "4 min." should read --- 4 mm. ---.

Signed and Sealed this

Twenty-eighth Day of January, 1997

*Attest:*

BRUCE LEHMAN

*Attesting Officer*

*Commissioner of Patents and Trademarks*